US005791962A

United States Patent [19]

Liu et al.

[11] Patent Number: 5,791,962

[45] Date of Patent: Aug. 11, 1998

[54] METHODS FOR MANUFACTURING FLAT COLD CATHODE ARRAYS

[75] Inventors: Nanchou David Liu, Chutung; Jammy Chin-Ming Huang, Taipei; Ching-Sung Chiu, Chutung, all of Taiwan

[73] Assignee: Industrial Technology Research Institute, Hsin-Chu, Taiwan

[21] Appl. No.: 899,656

[22] Filed: Jul. 24, 1997

Related U.S. Application Data

[62] Division of Ser. No. 566,810, Dec. 4, 1995, Pat. No. 5,683,282.

[51] Int. Cl.[6] ..... H01J 1/30; H01J 9/02

[52] U.S. Cl. ..... 445/50; 216/11; 216/39; 216/88; 313/336; 313/351; 445/24

[58] Field of Search ..... 445/24, 50; 313/309, 313/336, 351; 216/11, 39, 88, 89

[56] References Cited

U.S. PATENT DOCUMENTS

| | | | |
|---|---|---|---|
| 4,943,343 | 7/1990 | Bardai et al. | 156/643 |
| 5,053,673 | 10/1991 | Tomii et al. | 313/308 |
| 5,176,557 | 1/1993 | Okunuki et al. | 445/50 |
| 5,229,331 | 7/1993 | Doan et al. | 437/228 |
| 5,259,799 | 11/1993 | Doan et al. | 445/24 |
| 5,312,512 | 5/1994 | Allman et al. | 156/636 |
| 5,349,217 | 9/1994 | Boysel | 257/266 |
| 5,394,006 | 2/1995 | Liu | 257/506 |
| 5,451,830 | 9/1995 | Huang | 313/309 |
| 5,529,524 | 6/1996 | Jones | 445/24 |
| 5,635,081 | 6/1997 | Yoshihara | 216/11 |
| 5,662,815 | 9/1997 | Kim | 216/11 |
| 5,696,028 | 12/1997 | Rolfson et al. | 437/228 |

*Primary Examiner*—Kathryn L. Gorgos
*Assistant Examiner*—William T. Leader
*Attorney, Agent, or Firm*—Stephen B. Ackerman; George O. Saile

[57] ABSTRACT

Several methods for manufacturing field emission displays that operate using flat cone emitters are described. These methods are cost effective and relatively simple to implement. A key feature is the incorporation of chemical-mechanical polishing into the process. This allows the micro-cones, that would serve as cold cathodes in conventional structures, to be converted to flat cone emitters at the same time that the gate lines are being formed, the apexes of said flat cones being automatically located at the correct height relative to the gate lines.

12 Claims, 6 Drawing Sheets

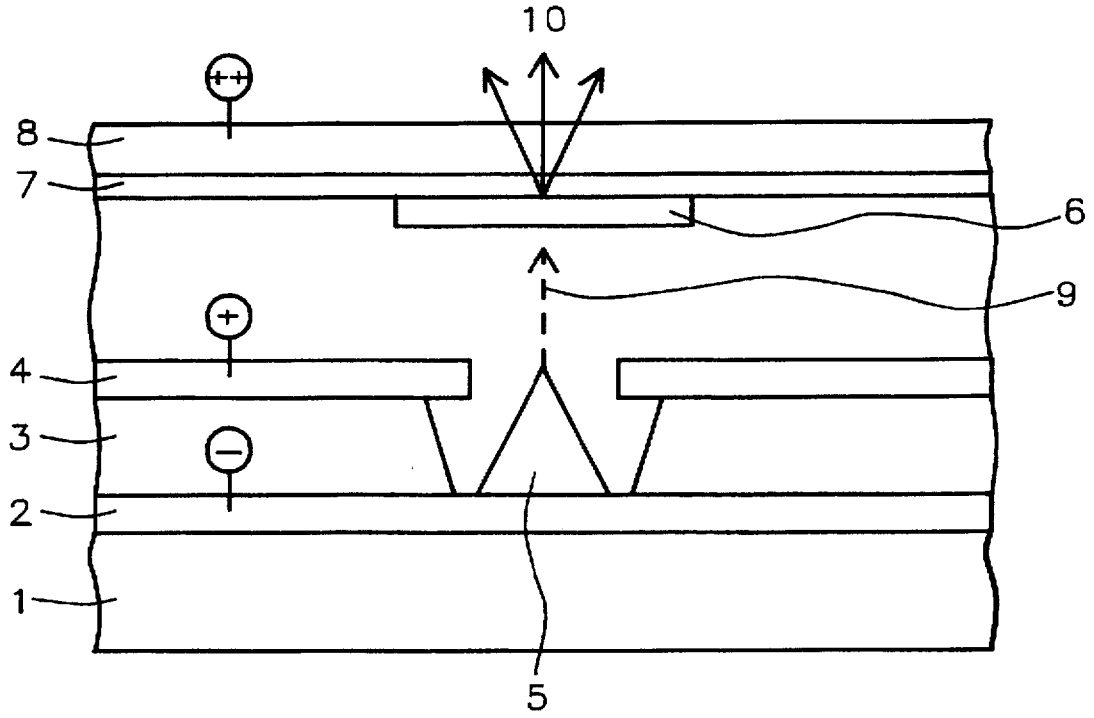
FIG. 1 – Prior Art
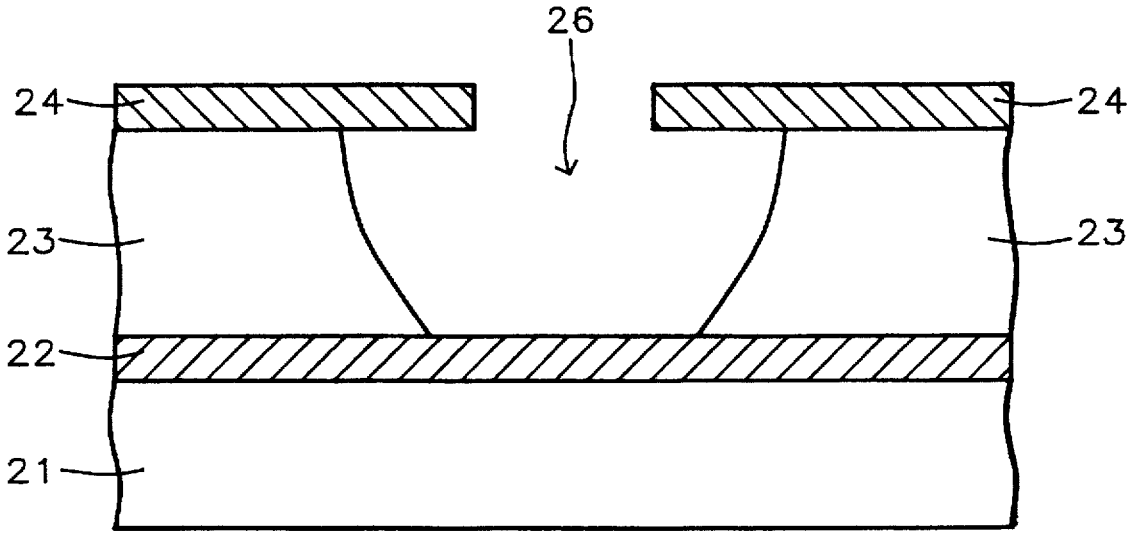
FIG. 2

METHODS FOR MANUFACTURING FLAT COLD CATHODE ARRAYS

This is a divisional application of application Ser. No. 08/566,810 filed Dec. 4, 1995, now U.S. Pat. No. 5,683,282.

BACKGROUND OF THE INVENTION (1) Field of the Invention

The invention relates to cold cathode field emission displays, more particularly to methods for manufacturing them.

(2) Description of the Prior Art

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small conical emitters, each of which is connected to a source of negative voltage via a cathode conductor line or column. Another set of conductive lines (called gate lines) is located a short distance above the cathode lines at an angle (usually 90°) to them, intersecting with them at the locations of the conical emitters or microtips, and connected to a source of positive voltage. Both the cathode and the gate line that relate to a particular microtip must be activated before there will be sufficient voltage to cause cold cathode emission.

The electrons that are emitted by the cold cathodes accelerate past openings in the gate lines and strike a cathodoluminescent panel that is located a short distance from the gate lines. In general, a significant number of microtips serve together as a single pixel for the total display. Note that, even though the local electric field in the immediate vicinity of a microtip is in excess of 10 million volts/cm., the externally applied voltage is only of the order of 100 volts.

In FIG. 1 we show, in schematic cross-section, the basic elements of a typical cold cathode display. A series of metallic lines 2 is formed on the surface of an insulating substrate 1. Said lines are referred to as cathode columns. At regular intervals along the cathode columns, microtips 5 are formed. These are typically cones of height about one micron and base diameter about one micron and comprise molybdenum or silicon, though other materials may also be used. In many embodiments of the prior art, local ballast resistors (not shown here) may be in place between the cones and the cathode columns.

A second series of metallic lines 4 are formed at right angles to the cathode columns, intersecting them at the locations of the microtips. A layer of insulation 3 supports lines 4, which are generally known as gate lines, placing them at the top level of the microtips, that is at the level of the apexes of the cones 5. Holes in the gate lines 4, directly over the microtips, allow streams of electrons 9 to emerge from the tips when sufficient voltage is applied between the gate lines and the cathode columns. Because of the local high fields right at the surface of the microtips, relatively modest voltages, of the order of 100 volts are sufficient.

After emerging through the openings in the gate lines, electrons 9 are further accelerated so that they strike fluorescent screen 6 where they emit visible light rays 10. Screen 6 is part of the top assembly which comprises a glass plate 8 on which has been deposited a transparent conducting layer 7 comprising a material such as indium-tin-oxide. Said top assembly is separated from the cold cathode assembly by spacers (not shown) and the space between these two assemblies is evacuated to provide and maintain a vacuum of the order of $10^{-7}$ torr.

The present invention is directed towards improved methods for manufacturing lower assemblies of the general form shown in FIG. 1. Boysel (U.S. Pat. No. 5,349,217 September 1994) describes a flat tipped (conical frustrum) emitter similar to that used in the present invention but by a method different from that of the present invention, while Allman (U.S. Pat. No. 5,312,512) is an example of the application of Chem.-Mech. polishing to the processing of silicon integrated circuits but is not obviously applicable to cold cathode devices which are normally manufactured without use of Chem.-Mech. polishing.

SUMMARY OF THE INVENTION

It has been an object of the present invention to provide a method, or methods, for manufacturing a field emission display that is cost effective.

A further object of the present invention has been to provide an economic method, or methods, for manufacturing a field emission display that operates using a flat cone emitter.

Yet another object of the present invention has been to provide an economic method, or methods, for manufacturing a field emission display that operates using a flat cone emitter and that has longer lifetime than currently available devices.

These objects have been achieved by incorporating chemical-mechanical polishing into the process for manufacturing the field emission displays. This allows the microcones that would normally serve as cold cathodes to be converted to flat cone emitters at the same time that the gate lines are being formed.

BRIEF DESCRIPTION OF THE DRAWINGS

FIG. 1 shows a typical field emission display of the prior art.

FIGS. 2 through 5 illustrate successive stages in the execution of the method that comprises the first embodiment of the present invention.

DESCRIPTION OF THE PREFERRED EMBODIMENTS

Figure 3:
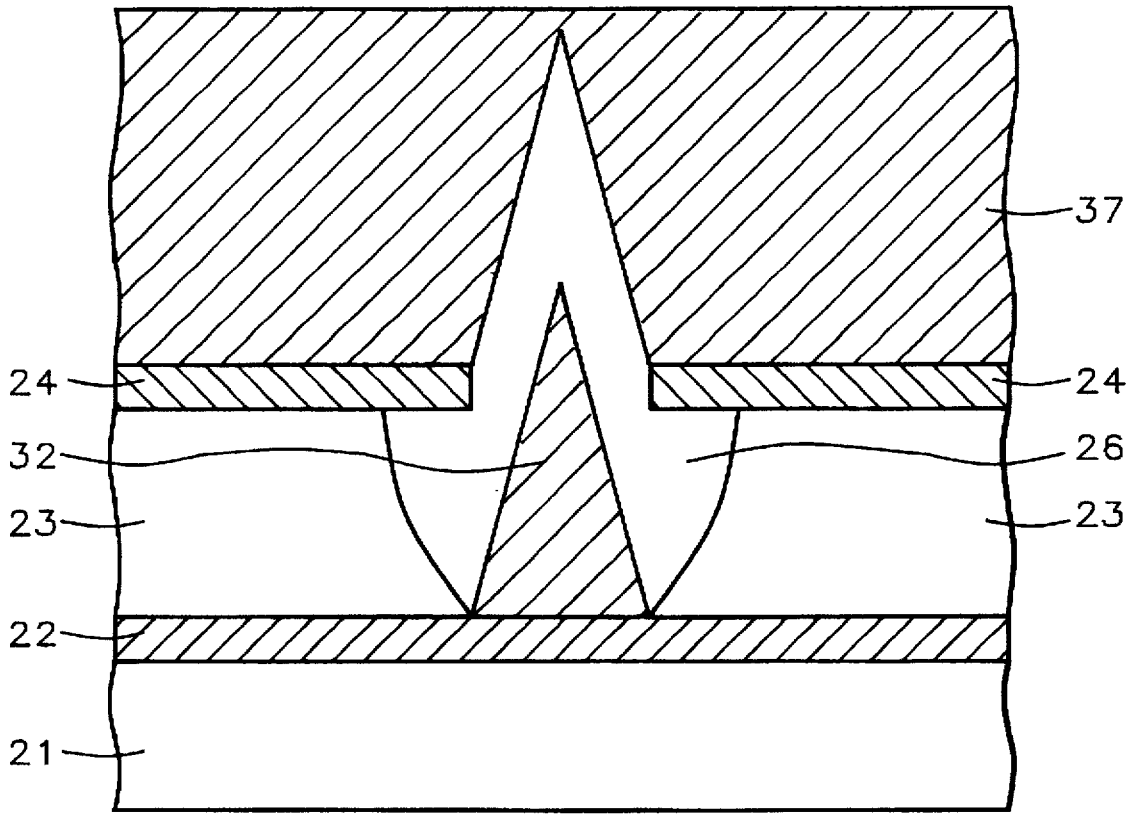

It has been known for some time that the high field emission phenomenon, associated with microtips as discussed above, is not actually due to the observable curvature of the microtips themselves. It has been found that the sharp points that emit the electrons are microscopic in nature, representing small pointed irregularities in an otherwise smooth surface. Even for a conventional microtip, as described above for the prior art, it is likely that several points will be emitting electrons, not just the apex of the microtip cone. Further confirmation of this is seen in the fact that emitters that are shaped in the form of a conical frustrum (a cone whose top has been sliced off so that the apex is now a flat circular area rather than a point) continue to emit electrons when used in place of fully conical emitters.

Frustrum (flat cone) emitters turn out to have several advantages over truly conical emitters. In particular, they have been found to provide larger, more uniformly distributed, emission currents, to be more stable, and to have longer active lifetimes. Accordingly, the present invention has been directed towards providing a more efficient method for the manufacture of such flat cone emitter devices than the manufacturing methods in current use. A key feature of the method is the use of chemical-mechanical (Chem.- Mech.) polishing to flatten the apexes of the microtips while at the same time causing said apexes to be at the correct height relative to the cathode columns and gate lines.

While a variety of chem.-mech. polishing methods exist, many of which being applicable to the present invention, our preferred chem.-mech. technique has been to use a slurry of alumina particles in a hydrogen peroxide etchant. Using this technique, we have achieved material removal rates for molybdenum between about 300 and 500 Angstroms per minute. It is also possible to use lapping or grinding in place of chem.-mech. polishing without departing from the spirit and effectiveness of the invention.

Referring now to FIG. 2, we describe a first embodiment of the general method. Cathode columns 22 were formed by depositing a layer of conductive material such as silicon or molybdenum to a thickness between about 3,000 and 5,000 Angstrom units onto insulating substrate 21 and then patterning and etching it. This was followed by depositing insulating layer 23, comprising material such as silicon oxide or silicon nitride to a thickness between about 5,000 and 15,000 Angstrom units over said cathode columns. Next, gate lines 24, running orthogonally to cathode columns 22 were formed by depositing a second conductive layer of material such as silicon or molybdenum to a thickness between about 3,000 and 5,000 Angstrom units onto insulating layer 23 and then patterning and etching it. This was followed by the etching of openings 26 in gate lines 24, further followed by the overetching of layer 23, using the modified gate lines as masks. This last etching step was allowed to proceed until regions, having areas at least as large as that of opening 26, were uncovered in the upper surface of 22. This also caused significant undercutting of openings 26 to occur. At this point in the process, the structure had the appearance shown in schematic cross-section in FIG. 2.

Referring now to FIG. 3, under vacuum, a stream of evaporated material, such as molybdenum, tungsten, aluminum, copper, or silicon, was now directed at the structure at an oblique angle of incidence while at the same time rotating the structure about an axis normal to its surface. The result of this procedure was that small cones 32 formed inside openings 26 in addition to the build-up of layer 37 on the top surface of the structure. Evaporation was terminated when the original shadowing effects of openings 26 ceased to play a role, layer 37 became continuous, and the cones in openings 26 were complete. At this point the thickness of layer 37 was between 1 and 2 microns, as was the height of cones 32. The deposition conditions for this step were chosen so that the apex of cone 32 extended well above the upper surface of layer 24, typically by about 5,000 Angstrom units. Note that this is a distinct departure from the prior art wherein it would be arranged for the apex of cone 32 to be level with, or just below layer 24.

Figure 4:
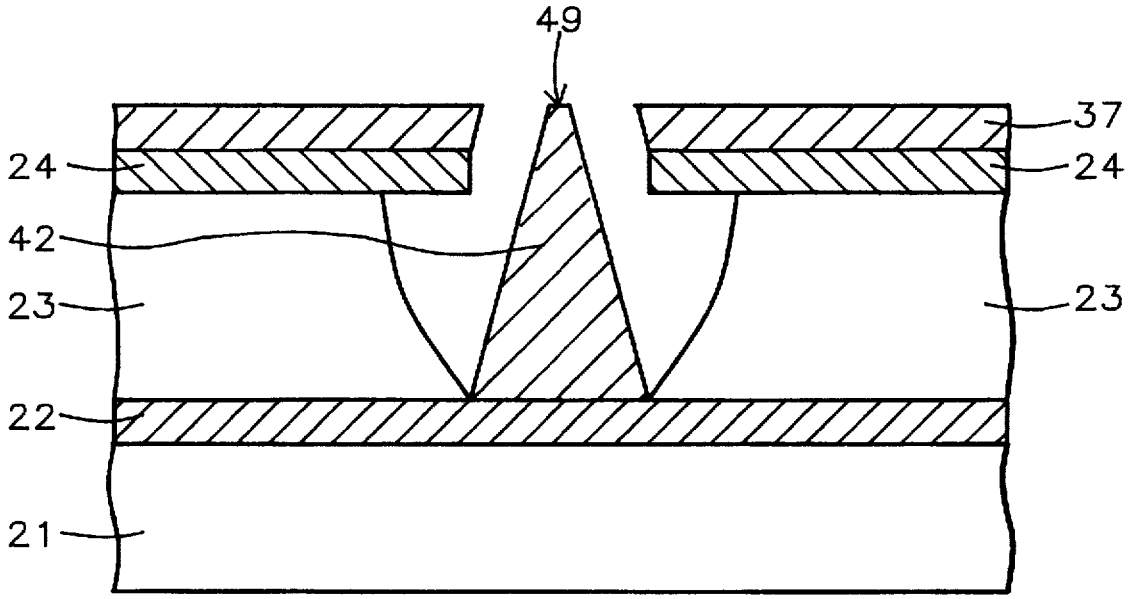
Figure 5:
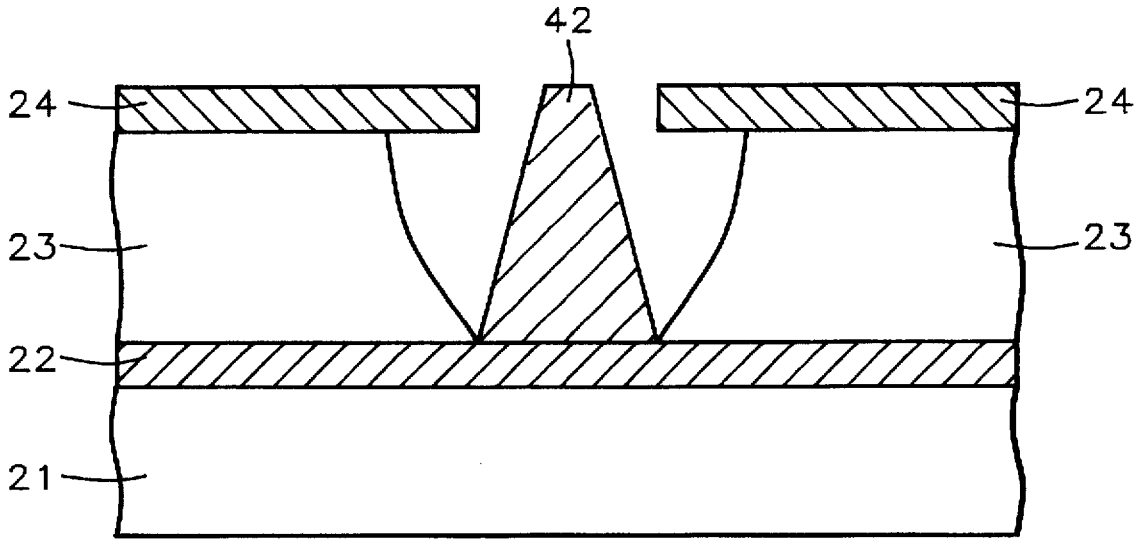

Referring to FIG. 4, the next step in the process is to use chem.-mech. polishing to remove material from layer 37, in a plane parallel to the substrate surface. Polishing is allowed to proceed until cone-shaped microtips 32 (in FIG. 3) have been transformed into conical frustra 42 having flat circular apexes 49 with diameters between about 0.2 and 0.4 microns. As an optional variation of this embodiment, the polishing is allowed to proceed until layer 37 has been removed in its entirety, giving the structure the appearance shown in FIG. 5.

Figure 6:
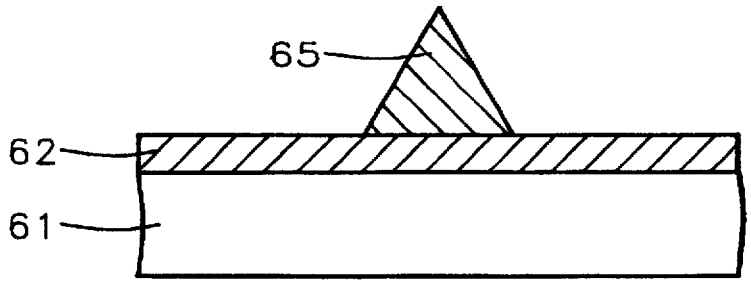
FIGS. 6 through 9 illustrate successive stages in the execution of the method that comprises the second embodiment of the present invention.

We start the description of a second embodiment of the general method of the present invention by referring to FIG. 6. Shown there (in schematic cross-section) is cone 65, comprising tantalum or silicon, evenly spaced and resting on cathode column 62 which, in turn, has been deposited and formed on insulating substrate 61. Formation of cone 65 could be by any of several methods currently in use in the art, including, but not limited to, the method discussed above and illustrated in FIGS. 2 and 3. Our preferred material for layer 62 has been silicon at a thickness between about 2,000 and 5,000 Angstrom units, although other materials such as molybdenum could also have been used.

Figure 7:
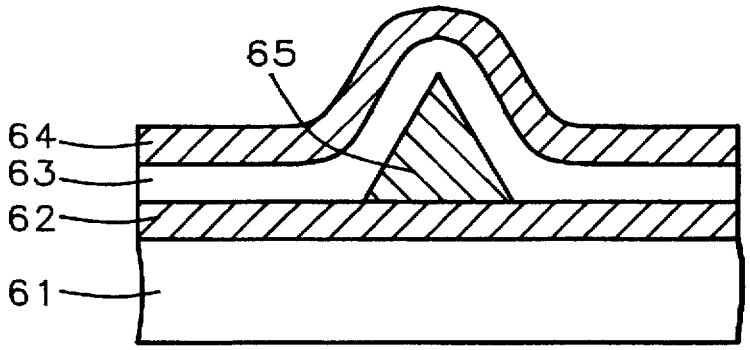
Figure 8:
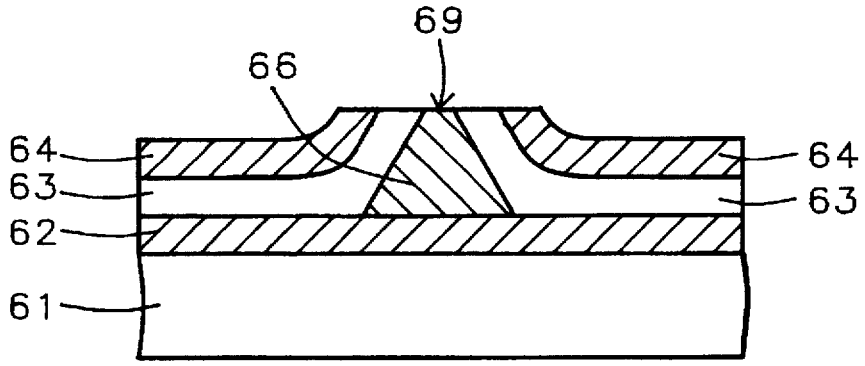
Figure 9:
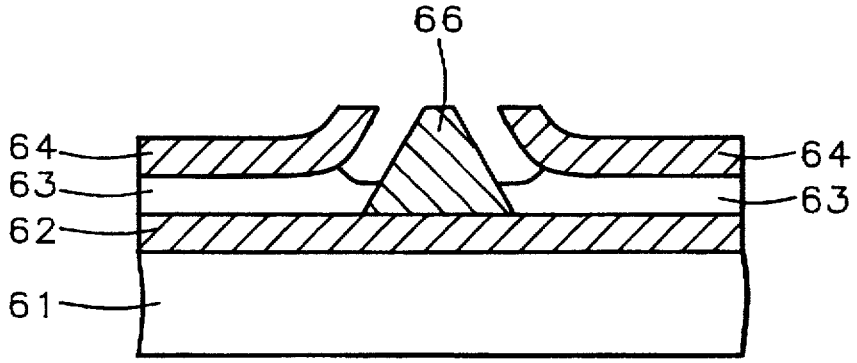

Moving on to FIG. 7, insulating layer 63, comprising silicon oxide or silicon nitride, and conductive layer 64, comprising silicon, molybdenum, tungsten, aluminum, or copper, are deposited over the structure. The thicknesses of these layers is between 2,000 and 5,000 Angstrom units for layer 63 and between 2,000 and 5,000 Angstrom units for layer 64, which is thin enough for the contours of these two layers to conform closely to those of layer 62, including, particularly, cone 65. This is followed by chem.-mech. polishing, as described for the first embodiment, to remove material from layers 63 and 64, in a plane parallel to the substrate surface. Polishing is allowed to proceed until cone-shaped microtip 65 has been transformed into a conical frustrum (labelled as 66 in FIG. 8) having a flat circular apex 69 with diameter between about 0.2 and 0.4 microns. As an optional variation of this embodiment, the silicon oxide that comprises layer 63 was etched in 5:1 buffered hydrofluoric acid for between about 1 and 3 minutes at about 25° C., giving it the appearance shown in FIG. 9.

A third embodiment of the general method of the present invention will be described by also initially referring to FIG. 6. Shown there (in schematic cross-section) is cone 65, comprising tantalum or silicon, evenly spaced and resting on cathode column 62 which, in turn, has been deposited and formed on insulating substrate 61. Formation of cone 65 could be by any of several methods currently in use in the art, including, but not limited to, the method discussed earlier and illustrated in FIGS. 2 and 3. Our preferred material for layer 62 has been silicon at a thickness between about 2,000 and 5,000 Angstrom units, although other materials such as molybdenum could also have been used.

Figure 10:
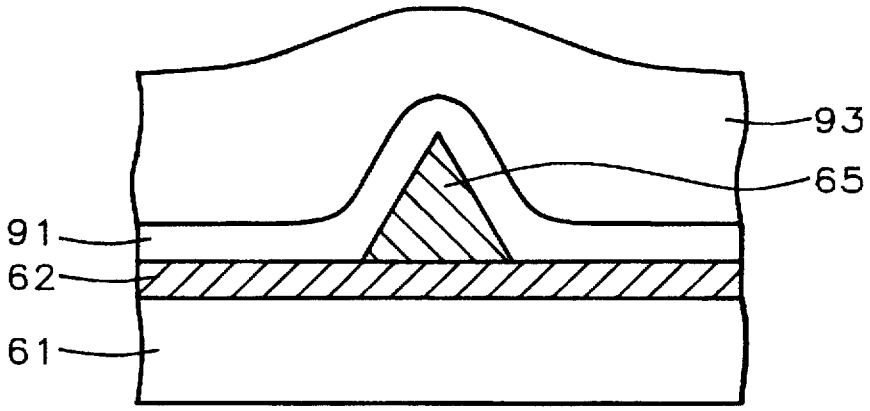
FIGS. 10 through 14 illustrate successive stages in the execution of the method that comprises the third embodiment of the present invention.

Referring now to FIG. 10, the process of the third embodiment proceeds with the deposition of conformal insulating layer 91, comprising silicon oxide or silicon nitride etc., to a thickness between about 2,000 and 5,000 Angstrom units. This is followed by the deposition of a second insulating layer 93, comprising silicon oxide or silicon nitride etc., to a thickness between about 1 and 2 microns (at least as thick as the height of cone 65) and less likely to be fully conformal.

Figure 11:
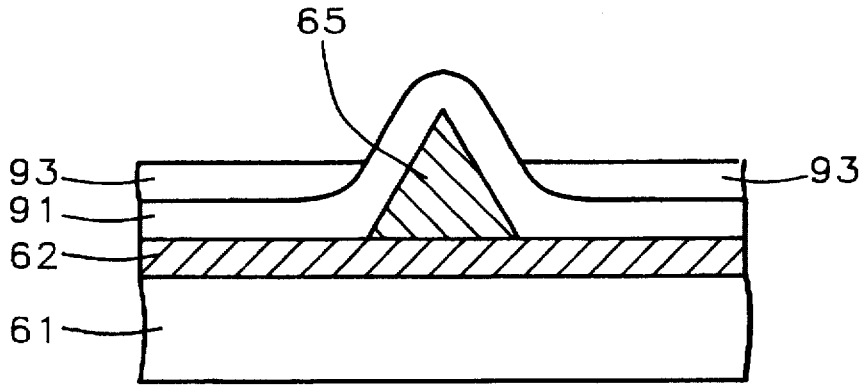
Figure 12:
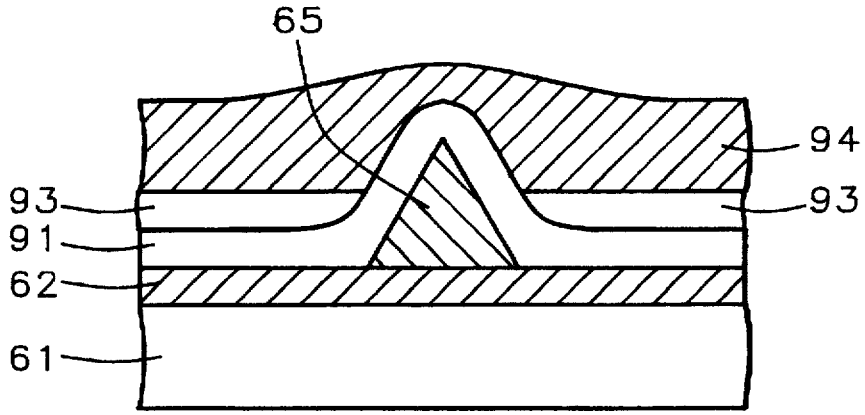

After a chemical-mechanical polishing step to planarize the surface of layer 93, a selective reactive ion etchant such as carbon hexafluoride is used to remove part of layer 93, without attacking layer 91, so that the structure, at this stage, has the appearance illustrated in FIG. 11. This is followed by deposition of conductive layer 94, comprising silicon, tungsten, or molybdenum, etc. to a thickness between about 0.5 and 1 microns (at least as thick as the amount by which layer 91 protrudes above layer 93 in FIG. 11), giving the structure the appearance illustrated in FIG. 12.

Figure 13:
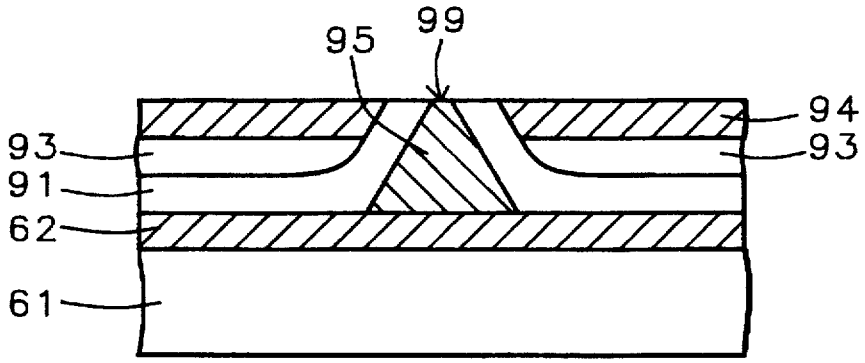
Figure 14:
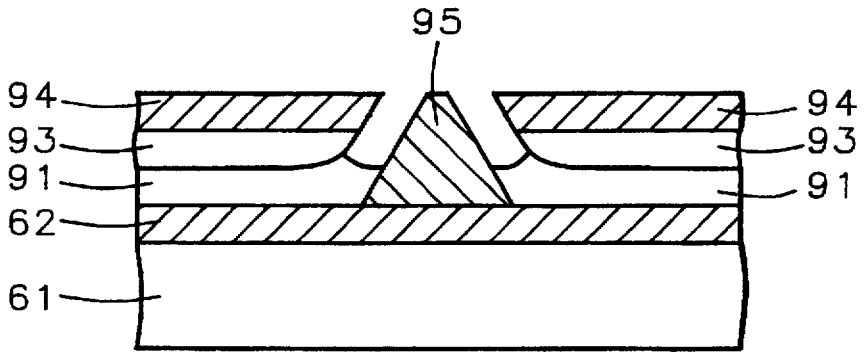

Referring now to FIG. 13, the structure is subjected to chem.-mech. polishing, as described for the first embodiment, to remove material from layer 94, in a plane parallel to the substrate surface. Polishing is allowed to proceed until cone-shaped microtip 65 has been transformed into a conical frustrum (labelled as 95 in FIG. 13) having a flat circular apex 99 with diameter between about 0.2 and 0.4 microns. As an optional variation of this embodiment, the structure was etched in 5:1 buffered hydrofluoric acid for between about 1 and 3 minutes at about 25° C., giving it the appearance shown in FIG. 14.

It should be noted that, while the three embodiments that are described above are variations on the same general method, the end structures that they produce vary slightly one from the other and, as a result, have somewhat different characteristics when used as part of field emission displays. In particular, structures resulting from the use of the methods of the first and third embodiments have a lower gate to cathode capacitance, as well as reduced gate to cathode leakage, relative to structures that result from using the method of the second embodiment. This is offset by the fact that the second embodiment is the simplest (therefore cheapest) process of the three embodiments that have been described. All three embodiments provide structures based on flat emission tips which, as already discussed, provide the advantages (over pointed tips) of higher emission stability, longer lifetime, and better emission uniformity.

While the invention has been particularly shown and described with reference to the above preferred embodiments, it will be understood by those skilled in the art that various changes in form and details may be made without departing from the spirit and scope of the invention.

What is claimed is:

1. A method for manufacturing a cold cathode array comprising:

providing an insulating substrate having an upper surface;

forming cathode columns on the upper surface of said substrate;

providing cone-shaped microtips, having apexes, evenly spaced, on said cathode columns;

coating said cathode columns and said microtips with a conformal first insulating layer having an upper surface;

coating said cathode columns and said microtips with a second insulating layer, having an upper surface, to a level higher than than that of said apexes above said cathode columns;

removing said second insulating layer, in a plane parallel to said upper surface of said substrate, until the upper surface of the second insulating layer is level with the highest portion of the upper surface of the first insulating layer;

then selectively etching said second insulating layer until its upper surface is lower than said apexes of said microtips;

depositing a conductive layer on said first and second insulating layers;

removing material from said insulating and said conductive layers, in a plane parallel to said upper surface of said substrate, until said cone-shaped microtips have been formed into conical frustra having flat circular apexes; and then patterning and etching said conductive layer to form gate lines.

2. The method of claim 1 wherein said cone-shaped microtips comprise tantalum or silicon.

3. The method of claim 1 wherein said first insulating layer comprises silicon oxide or silicon nitride.

4. The method of claim 1 wherein the thickness of said first insulating layer is between about 2,000 Angstrom units and about 5,000 Angstrom units.

5. The method of claim 1 wherein said second insulating layer comprises silicon oxide or silicon nitride.

6. The method of claim 1 wherein the thickness of said second insulating layer is between about 1 and about 2 microns.

7. The method of claim 1 wherein said conductive layer is taken from the group consisting of silicon, molybdenum, tungsten, aluminum, and copper.

8. The method of claim 1 wherein the thickness of said conductive layer is between about 2,000 Angstrom units and about 5,000 Angstrom units.

9. The method of claim 1 wherein the diameters of said flat circular apexes are between about 0.2 and about 0.4 microns.

10. The method of claim 1 wherein the method for removing material in a plane parallel to said upper surface of said substrate comprises chemical-mechanical polishing, or lapping or grinding.

11. The method of claim 1 further comprising:

selectively etching said first insulating layer to expose the sides of said conical frustra while leaving said second insulating layer and said conductive layer intact.

12. The method of claim 11 wherein the etching is performed in 5:1 buffered hydrofluoric acid at a temperature of about 25° C. for between 1 and 3 minutes.

* * * * *